US007311243B1

(12) United States Patent
Konzal

(10) Patent No.: US 7,311,243 B1
(45) Date of Patent: Dec. 25, 2007

(54) TWO PIECE PAPER CUP AND SIDEWALL BLANK THEREFOR

(75) Inventor: Daryl R. Konzal, Wauwatosa, WI (US)

(73) Assignee: Paper Machinery Corporation, Milwaukee, WI (US)

( * ) Notice: Subject to any disclaimer, the term of this patent is extended or adjusted under 35 U.S.C. 154(b) by 0 days.

(21) Appl. No.: 11/494,207

(22) Filed: Jul. 27, 2006

(51) Int. Cl.
*B65D 3/28* (2006.01)

(52) U.S. Cl. ..... 229/400; 229/4.5

(58) Field of Classification Search ..... 229/4.5, 229/400, 198.2

See application file for complete search history.

(56) References Cited

U.S. PATENT DOCUMENTS 1,069,675 A * 8/1913 Clausson ..... 229/400
2,017,810 A * 10/1935 Bodor et al. ..... 229/4.5
2,206,406 A * 7/1940 Koch ..... 229/4.5
3,145,131 A * 8/1964 Finke ..... 229/198.2
3,182,882 A * 5/1965 Aellen, Jr. et al. ..... 229/4.5
4,201,328 A 5/1980 MacEwen
4,558,813 A 12/1985 Richards
4,934,591 A * 6/1990 Bantleon ..... 229/4.5
5,775,577 A * 7/1998 Titus ..... 229/400
5,964,400 A * 10/1999 Varano et al. ..... 229/4.5
6,196,454 B1 * 3/2001 Sadlier ..... 229/198.2

* cited by examiner

*Primary Examiner*—Gary E Elkins
(74) *Attorney, Agent, or Firm*—Andrus, Sceales, Starke & Sawall, LLP

(57) ABSTRACT

A two-piece cup is formed by a sidewall member having an upper edge, a lower edge, a pair of opposite side edges, a front surface and a back surface with the opposite side edges overlapped and sealed along an overlapped side seam, and a bottom member sealed along the lower edge of the sidewall member. The upper edge of the sidewall member is curled into a continuous rim. Upper corners of the sidewall member are formed with a plurality of parallel score lines extending inwardly from each side edge immediately beneath the upper edge, the score lines overlapping in the side seam.

7 Claims, 3 Drawing Sheets

TWO PIECE PAPER CUP AND SIDEWALL BLANK THEREFOR

FIELD OF THE INVENTION

This invention relates generally to the manufacture of two piece, seamed paper cups coated with thermoplastic, and more particularly, pertains to the manufacture of cups having improved overlapped side seams at their rims, and also applies to all plastic two piece cups.

BACKGROUND OF THE INVENTION

The assignee of the instant application, Paper Machinery Corporation of Milwaukee, Wisconsin U.S.A. is the manufacturer of paper cup making machines used to make a variety of cups and containers. A typical cup machine for making paper cups, for instance, includes a turret having a plurality of mandrels about which the containers are formed. The turret sequentially rotates the mandrels into cooperation with a variety of workstations where numerous cup forming procedures occur.

In an exemplary procedure, a circular bottom blank is cut out at one workstation and attached to the end of a mandrel by a vacuum applied through the mandrel. During this procedure, the outside edge or lip of the bottom blank is folded downwardly. At a subsequent workstation, a sidewall blank is wrapped around the mandrel. The sidewall blank is heated and sealed along an overlapped side seam which runs generally longitudinal along the side of the cup. Typically, a paperboard is coated with a thermoplastic material such as polyethylene or a solid plastic sheet can be used, so the bottom and sidewall blanks may be heated and sealed together. In some applications, the sidewall blank includes a flap extending beyond the lip of the bottom blank, and this flap is bent over the lip. At a bottom finishing station, the flap is pressed against the lip from an inside recessed area of the bottom of the cup. By heating the polyethylene and firmly pressing the sidewall, sidewall flap, and bottom flap lid together, a bottom seal is formed and the cup is provided with a sturdy bottom region having a recessed area. There may also be other work stations where various other additional cup forming procedures are carried out. For example, one station may be used to provide a curl at the top or rim of the cup to provide a more functional drinking container and a better appearance.

The overlapped side seam is the most difficult area of the rim on a paper cup to form, because of the double layer of paper. It is very important to form the total rim consistent to match the plastic lid fit. At this point on the rim, two sealed together thicknesses of paper have four times the vertical strength of a single layer of paper. The outer layer of paper has to stretch, and the inner layer of paper compress to conform to a one paper layer rim around the rest of the rim. This formation causes shear to occur between the two layers leaving the outer layers split from the inner layer. The outer layer then bulges outwards and frays the very tip of the paper, separating the paper fibers within the outer layer. This affects the appearance and lid fit of the cup and the cup becomes commercially unacceptable. This distorted rim condition is commonly called flagging, as depicted at F in FIG. 1. To correct the rim forming of the double seam, two conditions need to be improved. The column strength of the overlapped paper and the shear between the two paper layers needs to be markedly reduced.

Accordingly, it is desirable to eliminate the flagging that occurs in the formation of the overlapped side seam on the rim of the cup so as to provide a smooth, uniform, aesthetic rim configuration which will ensure proper fit with a cooperating lid.

SUMMARY OF THE INVENTION

It is a general object of the present invention to provide a two piece cup having a smoothly rolled rim devoid of bulges, frays, splits, tails or tears around the overlapped portions of the sidewall.

The present invention relates to a two piece cup including a sidewall member having an upper edge, a lower edge and a pair of opposite side edges, a front surface and a back surface. Each of the side edges and the upper edge define upper corners. The side edges are overlapped and sealed together along an overlapping side seam. A bottom member has a peripheral edge sealed to the lower edge of the sidewall member. The upper corners of the sidewall member are formed with a plurality of spaced apart score lines along the front and back surfaces of the sidewall member such that upon forming the overlapped side seam, the score lines overlap and the upper edge of the sidewall member is curled to provide a continuous smoothly rolled rim.

In the preferred embodiment, the score lines are generally equal in length and extend generally horizontally inwardly from the opposite side edges immediately beneath the upper edge. The score lines extend inwardly for approximately one-quarter of an inch from each opposite side edge. A cross section of the sidewall member taken through the score lines takes the form of a wavy, sinusoidal configuration.

The invention further refers to a two piece cup formed by a sidewall blank having an upper edge, a lower edge, a pair of opposite side edges, a front surface and a back surface with the opposite side edges overlapped and sealed along an overlapped side seam to a bottom blank along a lower edge of the sidewall blank. The upper edge of the sidewall blank is curled into a continuous rim. The invention is improved wherein the upper corners of the sidewall blank are formed with a plurality of parallel score lines extending inwardly from each side edge immediately beneath the upper edge, the score lines overlapping when the side seam is formed.

In yet a further aspect of the invention, a cup forming sidewall blank includes a piece of flexible sheet material having an upper edge, a lower edge, a pair of opposite side edges, a front surface and a back surface, and upper corners formed with a plurality of spaced apart score lines on the front and back surfaces. In the preferred embodiment, the sheet material has a generally trapezoidal shape.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 2:
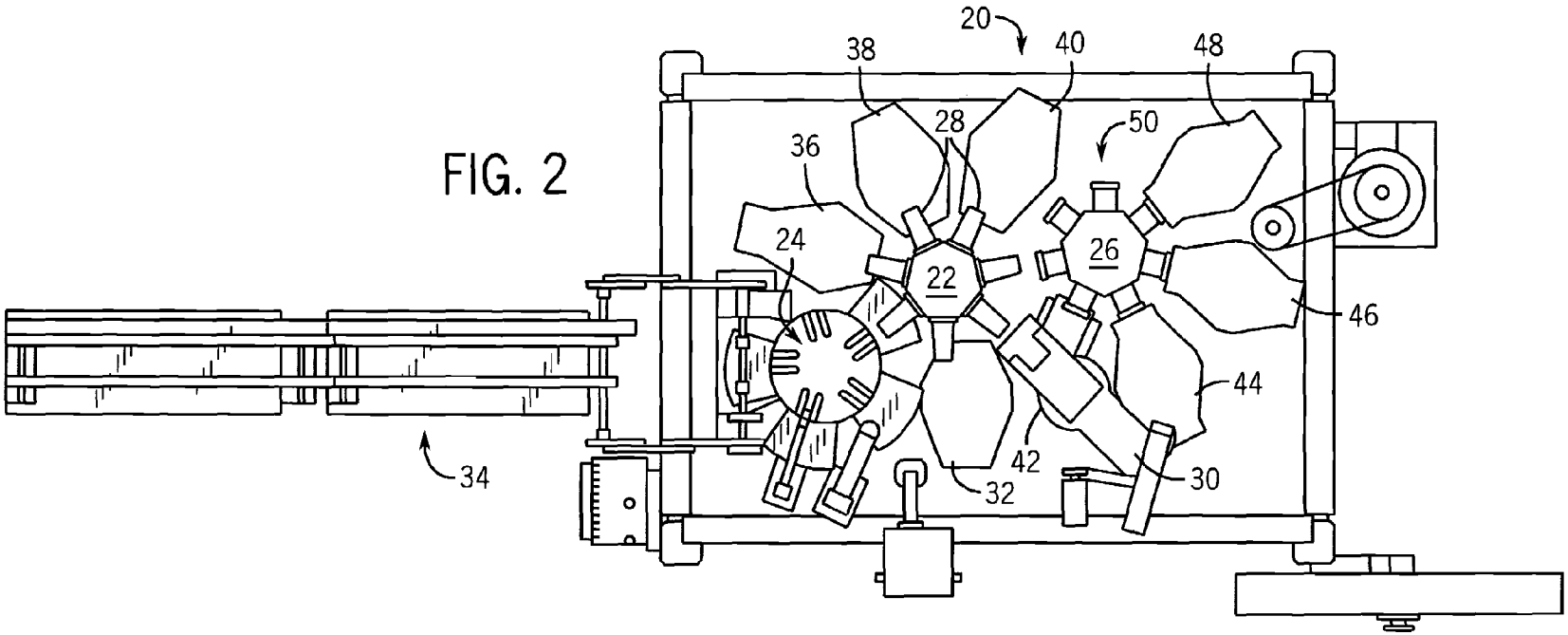
FIG. 2 is a schematic top plan view of a cup making machine for making a cup with the sidewall blank of the present invention.

Referring generally to FIG. 2, an exemplary cup making machine 20 is illustrated. This particular design includes a mandrel turret 22 which cooperates with a transfer turret 24 and a rimming turret 26. Mandrel turret 22 includes a plurality of mandrels 28 that are rotated in a stepwise or indexing manner between surrounding workstations. For example, a bottom blank may be applied to a given mandrel 28 at a bottom blank maker workstation 30 and then rotated to a bottom reformer station 32. From this point, the mandrel 28 is rotated into cooperation with the transfer turret 24 which receives sidewall blanks from a hopper 34 and rotates the sidewall blank into cooperation with an adjacent mandrel 28. The sidewall blank is then folded about the mandrel over the bottom blank, heated and sealed along a side seam where the opposite side edges of the sidewall blank overlap.

Next, the bottom blank and the sidewall blank are rotated to a bottom heat station 36. After heating, mandrel turret 22 indexes the subject mandrel 28 into registration with a roller incurl workstation 38 where a portion of the sidewall blank, i.e. a sidewall blank flap, is bent over an outer lip of the bottom blank to form a recessed bottom in the cup. The cup is then moved to a bottom finish station 40 where the sidewall blank flap and the bottom blank lip are pressed against the lower region of the sidewall blank to form a bottom seal.

Once the bottom is formed and sealed, the cup is transferred to rimming turret 26, rotated to a lube station 42 and then rotated to a rimming precurl station 44 where the upper lip of the sidewall is curled outwardly. From that station, the cup is indexed to a rimming finish curl station 46 which finishes the curled portion along the top of the cup to make an attractive edge. At this point, the cup may be moved to an optional lid groover station 48 and then to a cup blowoff station 50 for removal of the finished cup.

Figure 1:
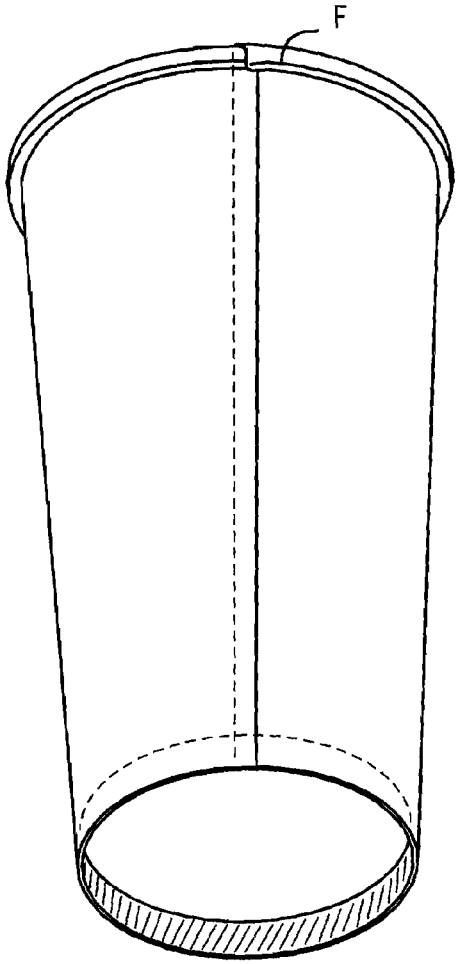
FIG. 1 is a perspective view of a two piece cup having a distorted overlapped side seam with flagging at the curled rim.
Figure 3:
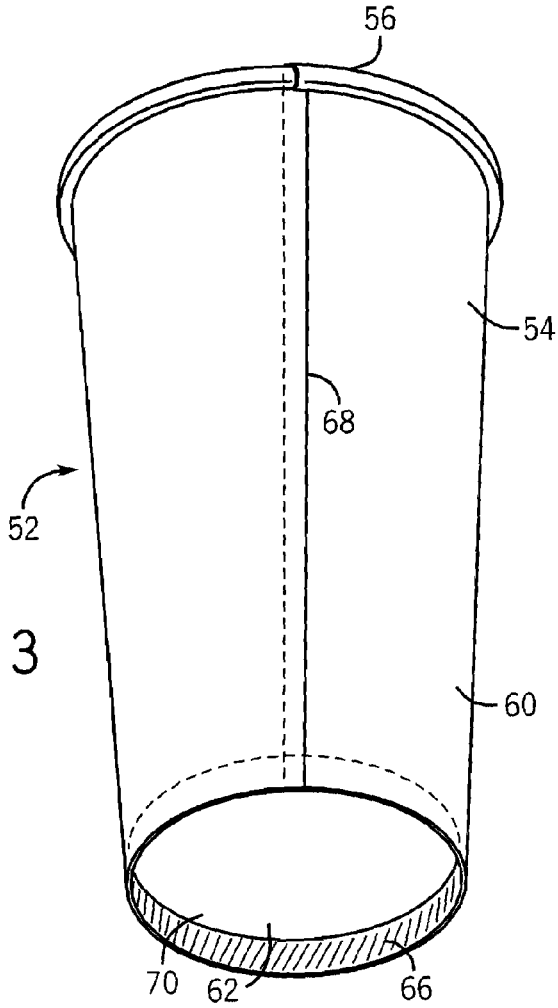
FIG. 3 is a perspective view of a cup made from the sidewall blank of the present invention.
Figure 4:
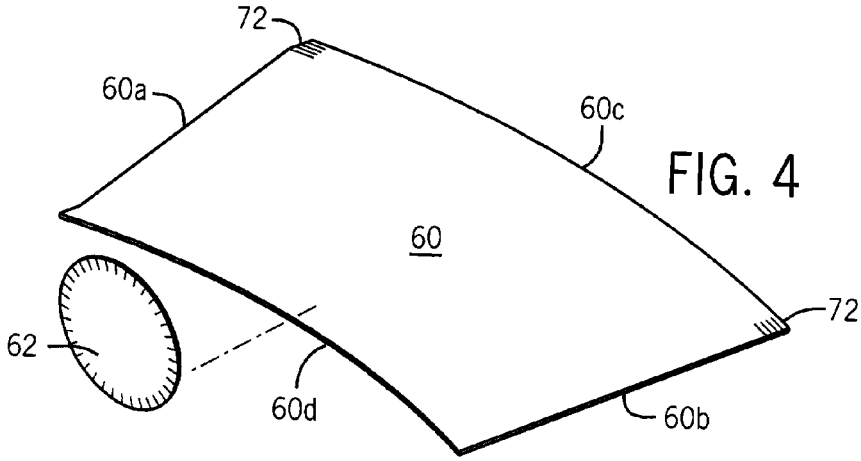
FIG. 4 is a schematic representation of the bottom blank and the sidewall blank forming the cup of FIG. 3.
Figure 5:
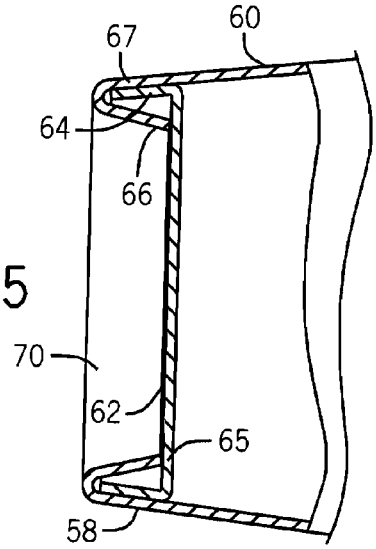
FIG. 5 is a sectional view showing the area at which the sidewall blank is joined to the bottom blank.

Referring to FIGS. 3-5, an exemplary cup 52 includes an upper region 54 having a curled rim 56 and a bottom region 58. Cup 52 is made from a flexible sheet member or sidewall blank 60 of generally trapezoidal shape which is wrapped around a circular bottom blank disposed generally transverse thereto. Sidewall blank 60 has opposite side edges 60*a*, 60*b*, an upper edge 60*c* and a lower edge 60*d*. Bottom blank 62 is typically bent or folded over in proximity to its outer edge to form a lip 64. The sidewall blank 60 is located with respect to bottom blank 62 so that a flap portion 66 having a bottom edge 65 extends beyond lip 64. Flap portion 66 is bent or folded around lip 65 so lip 64 may be squeezed between flap portion 66 and the lower region 67 of sidewall blank 60 (see FIG. 5).

A typical cup 52 is made from paperboard blanks having a thermoplastic coating such as polypropylene. The thermoplastic material permits heating and sealing of adjacent components. For instance, when sidewall blank 60 is wrapped around bottom blank 62, adjacent overlapped edges 60*a*, 60*b* are heated and pressed together along an overlapped side seam 68. Similarly, lip 64, flap portion 66 and lower region 67 of sidewall blank 60 may be heated and pressed together at bottom finish station 40 to form a strong, leak-proof bottom region 58. By forming cup 52 as illustrated in FIG. 5, a recessed area 70 is created in the bottom of cup 52 on an opposite side of bottom blank 62 from the main container region of cup 52. Recessed areas 70 permit insertion of a tool to press lip 64 and flap portion 66 towards the lower region 67 of sidewall blank 60 and form the bottom seal.

In accordance with the present invention, the sidewall blank 60 is prescored at selected locations so as to overcome the flagging condition discussed in the Background of the Invention, and improve the quality of the overlapped side seam at the curled rim 56 of the cup 52.

Figure 7:
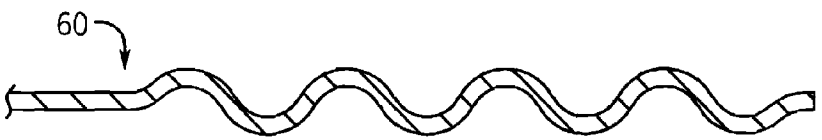
FIG. 7 is a sectional view taken on line 7-7 of FIG. 6.
Figure 6:
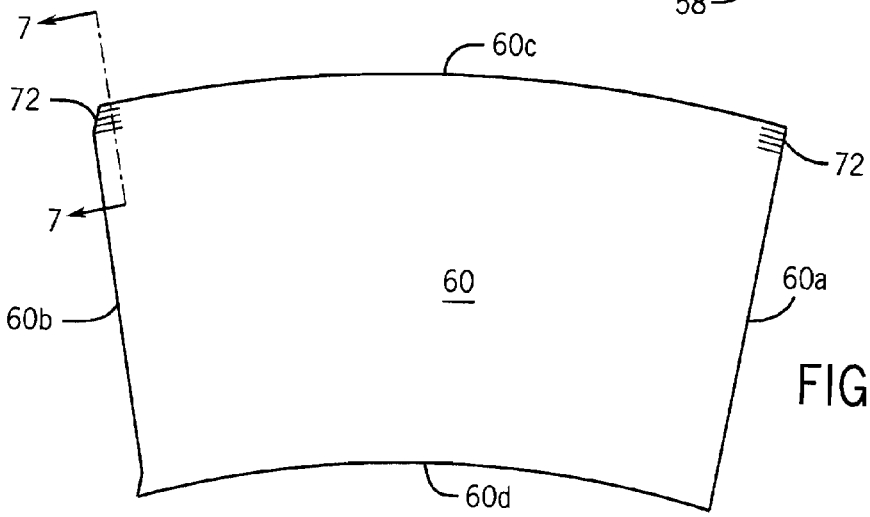
FIG. 6 is a rear view of the sidewall blank.

Referring now to FIGS. 6 and 7, uppermost corners of sidewall blank 60 are formed on their front and back surfaces with a series of vertically spaced apart, parallel horizontally extending score lines 72. In the preferred embodiment, the score lines 72 are generally equal in length and extend inwardly for about one-quarter inch from a typical corner cut 74 on edge 60*a* and about one-quarter inch from the straight edge 60*b*. When seen in cross section (FIG. 7), the score lines 72 present a wavy, sinusoidal configuration. When the scored corners of the sidewall blank 60 are sealed in the overlapped side seam 68, the column strength of the double layer of paperboard at the top end of the seam 68 is greatly reduced. This allows the inner layer of paper to compress easily and permits the outer layer of paper to stretch adequately. In addition, the shear force between the outer and inner layers of paper is markedly reduced so that the seal between the layers remains intact. Once the improved overlap side seam 68 is formed, the cup 52 is moved to the rimming precurl station 44 and the finish curl station 46 so as to provide an attractive curl top edge which will cooperatively mate with a complimentary lid.

While the invention has been described with reference to a preferred embodiment, those skilled in the art will appreciate that certain substitutions, alterations and omissions may be made without departing from the spirit thereof. For example, the scores may have a diamond shape. Accordingly, the foregoing description is meant to be exemplary only and should not be deemed limitative on the scope of the invention set forth with the following claims.

I claim:

1. A two piece cup comprising:

a sidewall member having an upper edge, a lower edge, a pair of opposite side edges, a front surface and a back surface, each of the side edges and the upper edge defining upper corners, the side edges being overlapped and sealed together along an overlapping side seam, and a bottom member having a peripheral edge sealed to the lower edge of the sidewall member, wherein the upper corners of the sidewall member are formed with a plurality of spaced apart score lines along the front and back surfaces of the sidewall member such that in the overlapped side seam, the score lines overlap and the upper edge of the sidewall member is curled to provide a continuous smoothly rolled rim.

2. The cup of claim 1, wherein the score lines are generally equal in length and extend generally horizontally and inwardly from the opposite side edges immediately beneath the upper edge.

3. The cup of claim 2, wherein the score lines extend inwardly for approximately one-quarter inch to ⅜".

4. The cup of claim 1, wherein a cross section of the sidewall member taken through the score lines takes the form a wavy, sinusoidal configuration

5. In a two piece cup formed by a sidewall member having an upper edge, a lower edge, a pair of opposite side edges, a front surface and a back surface with the opposite side edges overlapped and sealed along an overlapped side seam, and a bottom member sealed along the lower edge of the sidewall member, the upper edge of the sidewall member being curled into a continuous rim, the improvement wherein:

upper corners of the sidewall member are formed with a plurality of parallel score lines extending inwardly from each side edge immediately beneath the upper edge, the score lines overlapping in the side seam.

6. A cup-forming sidewall blank comprising:

a piece of flexible sheet material having an upper edge, a lower edge, a pair of opposite side edges, a front surface and a back surface, and only upper corners formed with a plurality of spaced apart score lines on the front and back surfaces extending horizontally and inwardly from each side edge.

7. The sidewall blank of claim 6, wherein the sheet material has a generally trapezoidal shape.

* * * * *